US007047746B2

(12) United States Patent
Hellat

(10) Patent No.: US 7,047,746 B2
(45) Date of Patent: May 23, 2006

(54) CATALYTIC BURNER

(75) Inventor: Jaan Hellat, Baden-Ruetihof (CH)

(73) Assignee: ALSTOM Technology Ltd., Baden (CH)

( * ) Notice: Subject to any disclaimer, the term of this patent is extended or adjusted under 35 U.S.C. 154(b) by 84 days.

(21) Appl. No.: 10/414,028

(22) Filed: Apr. 16, 2003

(65) Prior Publication Data

US 2003/0205048 A1 Nov. 6, 2003

(30) Foreign Application Priority Data

May 2, 2002 (CH) ..... 2002 0737/02

(51) Int. Cl.
*F02C 1/00* (2006.01)
*F02G 3/00* (2006.01)

(52) U.S. Cl. ..... 60/723; 60/748; 431/170; 431/328

(58) Field of Classification Search ..... 60/723, 60/748; 431/170, 328
See application file for complete search history.

(56) References Cited

U.S. PATENT DOCUMENTS 3,943,705 A 3/1976 DeCorso et al.
4,731,989 A * 3/1988 Furuya et al. ..... 60/775
5,000,004 A * 3/1991 Yamanaka et al. ..... 60/723
5,202,303 A 4/1993 Retallick et al.
5,431,017 A * 7/1995 Kobayashi et al. ..... 60/723
5,452,574 A * 9/1995 Cowell et al. ..... 60/39.23
5,623,819 A * 4/1997 Bowker et al. ..... 60/776
5,826,422 A * 10/1998 Koyama et al. ..... 60/39.12
6,070,411 A * 6/2000 Iwai et al. ..... 60/737
6,105,360 A * 8/2000 Willis ..... 60/777
2001/0027637 A1 10/2001 Norster et al.

FOREIGN PATENT DOCUMENTS

EP 0 810 405 12/1997
EP 0 845 634 6/1998

OTHER PUBLICATIONS

Patent Abstracts of Japan, vol. 011, No. 135 (M-585), Apr. 28, 1987 & JP 61 276627 A (Toshiba Corp), in der Anmeldung erwähnt Zusammenfassung.
Search Report, prepared by the European Patent Office, for Swiss Appl. No. CH 7372002, issued Jul. 18, 2001.
Search Report from EP 03 10 0949 (Aug. 13, 2003).

* cited by examiner

*Primary Examiner*—William H. Rodriguez
(74) *Attorney, Agent, or Firm*—Cermak & Kenealy, LLP; Adam J. Cermak

(57) ABSTRACT

A catalytic burner (1) of a combustion chamber (2), in particular of a power plant, includes at least one catalyst (5) and one swirl generator (6). To improve the burner (1), the swirl generator is designed as a radial swirl generator (6) and is arranged radially between an inflow space (7) and an outflow space (8) leading axially to the combustion chamber (2).

43 Claims, 6 Drawing Sheets

CATALYTIC BURNER

This application claims priority under 35 U.S.C. § 119 to Swiss application number 2002 0737/02, filed May 2, 2002.

TECHNICAL FIELD

The invention relates to a catalytic burner at or for a combustion chamber, in particular of a power plant.

PRIOR ART

JP 61 276 627 A discloses a catalytic burner of this type which has an annularly arranged catalyst, through which the flow passes when the burner is in operation, and a swirl generator, through which the flow passes when the burner is in operation. In this case, the swirl generator is designed as an axial swirl generator, through which the flow passes in the axial direction and which at the same time acts with a swirl upon the flow. The axial swirl generator is in this case arranged concentrically within the catalyst, so that the flow passes in parallel through the catalyst and swirl generator.

PRESENTATION OF THE INVENTION

The present invention is concerned with the problem of specifying, for a catalytic burner of the type initially mentioned, an improved embodiment in which, in particular, combustion stability in the combustion chamber is increased.

The invention is based on the general notion of using, for acting with a swirl upon the burner flow, a radial swirl generator, that is to say a swirl generator through which the flow passes radially and which at the same time generates a swirl flow emerging axially. In the case of a radial swirl generator, for the same outlet cross section, the flow resistance is lower than with an axial swirl generator. Correspondingly, in the burner according to the invention, there is a smaller pressure drop, this being particularly advantageous here, since the throughflow of the catalyst or catalysts is always accompanied by a pressure drop.

It is particularly advantageous to have a version in which the swirl generator and the catalyst or catalysts are arranged in the same flow path, so that the entire flow lead through the catalyst or catalysts is or becomes acted upon by the swirl. This leads to intensive intermixing even before entry into the combustion chamber.

According to a preferred embodiment, the radial swirl generator may have a plurality of rectilinear swirl generator ducts which in each case are inclined with respect to the radial direction in the circumferential direction and which connect a radially outer inflow space to a radially inner outflow space. This form of construction possesses relatively low throughflow resistance. The rectilinear swirl generator ducts possess, in their longitudinal direction, a constant cross section which, in particular, makes it possible to insert especially simply constructed and therefore cost-effective catalysts into the swirl generator ducts. For example, conventional monolithic catalysts with rectilinear and parallel catalyst ducts or cells may be used. It is thereby possible to resort to standard components, this being particularly cost-effective. Instead of monolithic catalysts, it is also possible to use catalysts which are produced from zigzag-folded or corrugated metal sheets by multiply folding, layering or winding.

It is particularly important, in this case, that the catalysts are integrated into the radial swirl generator, thus resulting in an especially compact construction for the burner according to the invention.

Further features and advantages of the burner according to the invention may be gathered from the drawings and from the accompanying figure description with reference to the drawings.

BRIEF DESCRIPTION OF THE DRAWINGS

Preferred exemplary embodiments of the invention are illustrated in the drawings and are explained in more detail in the following description, the same reference symbols relating to identical or similar or functionally identical components. In the drawings, in each case diagrammatically.

In FIG. 1, a burner 1 according to the invention is connected to a combustion chamber 2, in the combustion space 3 of which are generated, when the burner is in operation, hot combustion exhaust gases which, in a preferred application, are supplied to a gas turbine of a power plant. The burner 1 contains a catalyst arrangement 4 consisting of a plurality of catalysts 5, through which the flow passes when the burner is in operation. The latter is correspondingly a catalytic burner 1. This burner 1, moreover, contains a swirl generator 6 which is designed as a radial swirl generator, that is to say the flow passes through the swirl generator 6 radially, here radially from the outside inward, said swirl generator imparting a swirl to the flow. The radial swirl generator 6 is in this case arranged between a radially outer inflow space 7 and a radially inner outflow space 8. The swirl generator 6 and the catalyst arrangement 4 are in this case arranged concentrically to a longitudinal axis 9 of the burner 1. The outflow space 8 leads in the axial direction, that is to say parallel to the longitudinal axis 9, to the combustion chamber 2 and thus connects the outflow side of the swirl generator 6 to the combustion space 3.

Figure 1:
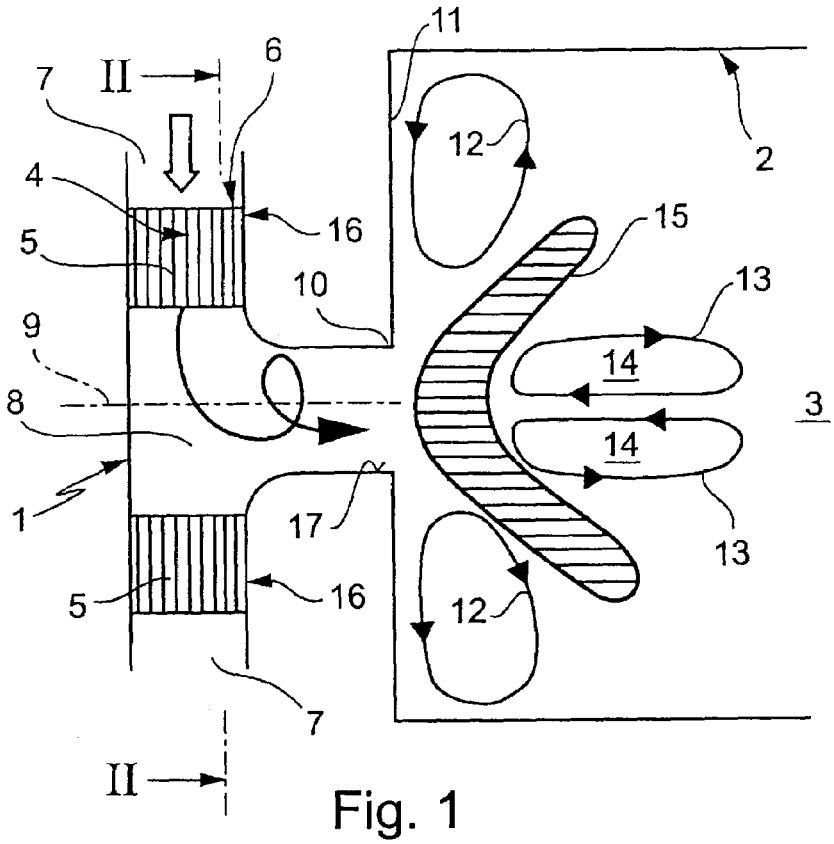
FIG. 1 shows a longitudinal section through a greatly simplified basic illustration of a burner according to the invention.

A transition 10 between the outflow space 8 and the combustion space 3 possesses here, a cross-sectional widening 11 which, in particular, may be formed abruptly. By virtue of this cross-sectional widening 11, the swirl flow generated in the burner 1 can virtually burst open in the combustion space 3, as a result of which, on the one hand, a first vortex system 12 is generated in the region of the cross-sectional widening 11 and, on the other hand, a central second vortex system 13 is generated in the combustion space 3. With the aid of the second vortex system 13, a central recirculation zone 14 is generated in the combustion chamber 2 and anchors and stabilizes a flame front 15 in the combustion chamber 2 in what is known as the "plenum", that is to say in the vicinity of the burner 1.

Figure 2:
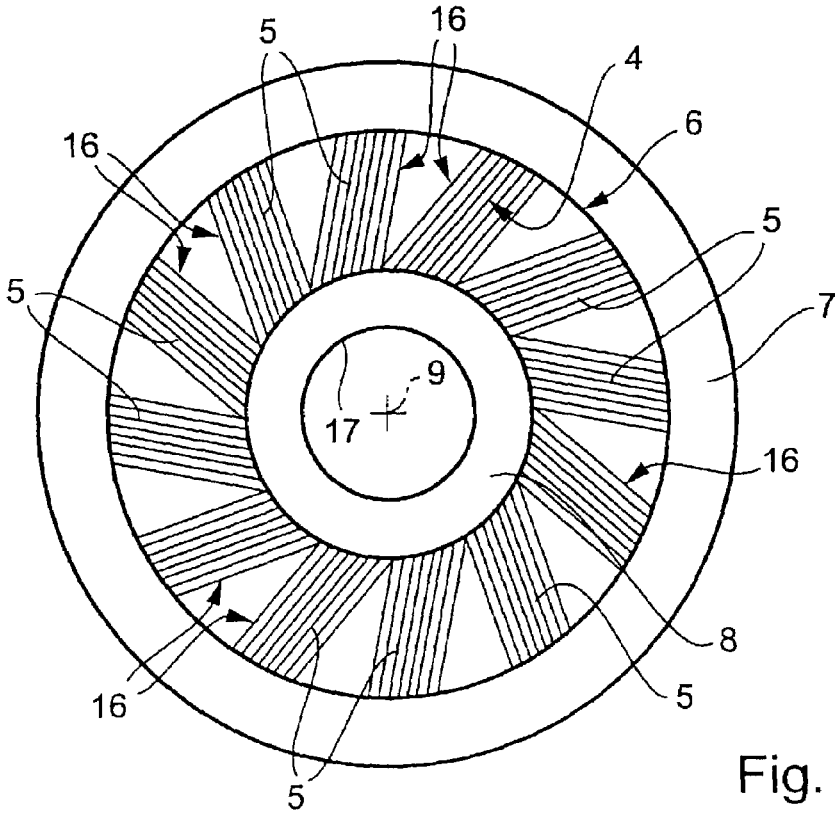
FIG. 2 shows a cross section through the burner according to FIG. 1 along the sectional lines II.

According to FIG. 2, the radial swirl generator 6 possesses a plurality of swirl generator ducts 16 which are in each case inclined in the same way in the circumferential direction with respect to a radial direction starting from a central longitudinal axis 9. This orientation of the swirl generator duct 16 results in the desired swirl when the flow passes through them. Expediently, in this case, the swirl generator ducts 16 are aligned tangentially with an outlet cross section 17, through which the gas flow enters the combustion space 3 from the outflow space 8.

Expediently, the swirl generator ducts 16 are of rectilinear design with a cross section which is constant in their longitudinal direction. It is thereby possible to insert particularly simply constructed catalysts 5 into the swirl generator ducts 16. For example, the individual catalysts 5 consist of ceramic monoliths which are catalytically coated in a suitable way. It is likewise possible to construct the catalysts 5 by means of a stack or a winding of corrugated or zigzag-folded sheet metal webs which are likewise catalytically activated by means of a suitable coating. The catalysts 5 in each case contain a multiplicity of catalyst ducts, not designated in any more detail, which in each case run parallel to one another and parallel to the swirl generator ducts 16. In order to avoid an overheating of the catalysts 5 when the burner is in operation, it may be expedient to carry out the coating of the individual catalyst ducts in such a way that not all the catalyst ducts, for example only every second catalyst duct, is designed to be catalytically active. In a construction of this type, no combustion reaction takes place in the catalytically inactive catalyst ducts, so that the flow carried in them serves for cooling the adjacent catalyst ducts in which combustion reactions occur. A catalyst construction of this type is basically known from U.S. Pat. No. 5,202,303 and therefore does not have to be explained in any more detail.

By the individual catalysts 6 being inserted into the swirl generator ducts 16, the catalysts 5 or the catalyst arrangement 4 are integrated into the swirl generator 6. It is particularly important, in this case, that, in this construction, the flow led through the catalysts 5 is acted upon simultaneously with the desired swirl.

Since the catalysts 5 are arranged in the radial swirl generator 6, they are positioned on a radius which is larger than the radius of the outlet cross section 17. Correspondingly, a smaller pressure drop is obtained from the throughflow of the catalysts 5 than in the case of a comparable arrangement with a straightforward axial throughflow. The flow velocity in the catalyst ducts and the pressure loss of the catalysts 5 can be set, on the one hand, via the length of the catalysts 5 and via their cell density and also by means of the axial extent of the catalysts 5 or of the swirl generator ducts 16 and therefore of the swirl generator 6. Expediently, the burner 1 is designed in such a way that, when the burner is in operation, at least in the outflow space 8, the flow velocity is higher than a turbulent flame velocity at which the flame front 15 may be propagated toward the burner 1. A propagation of the flame front 15 into the outflow space 8 can be avoided by means of this measure. Alternatively or additionally, the burner 1 is designed in such a way that, when the burner is in operation, a dwell time of the flow in the outflow space 8 is shorter than a time delay up to the autoignition of the partially reacted hot fuel/oxidizer mixture flowing into the outflow space 8. By virtue of this measure, the hot gas generation provided for the combustion space 3 can be kept away from the outflow space 8. Said measures in each case contribute to the fact that an overheating of the catalysts 5 or of the swirl generator 6 can be avoided.

Figure 3:
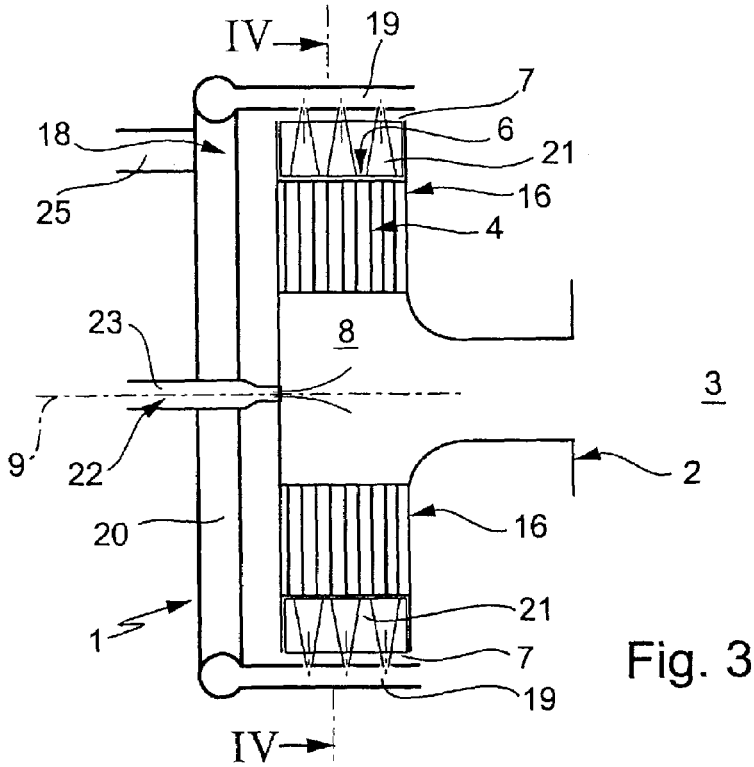
FIG. 3 shows a further-simplified longitudinal section through the burner in another embodiment.
Figure 4:
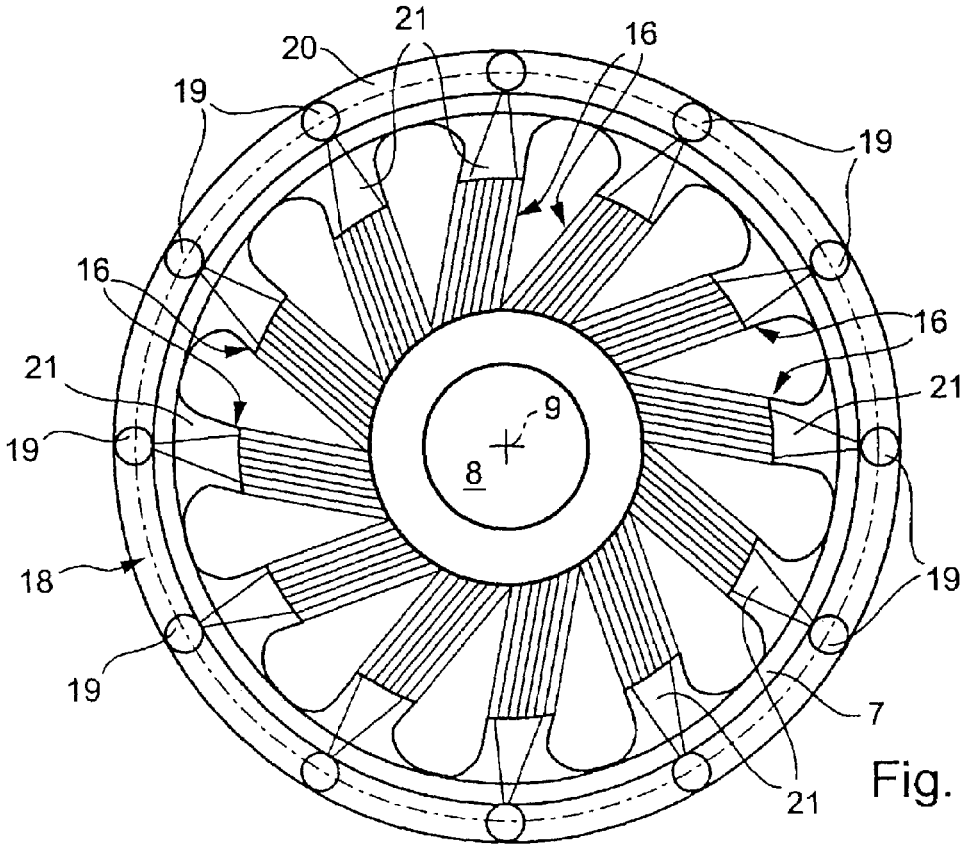
FIG. 4 shows a cross section through the burner according to FIG. 3 along the sectional lines IV.

According to FIGS. 3 and 4, the embodiment of the burner 1 shown there comprises a primary injection device 18 having a plurality of injectors 19 which are connected to a common ring conduit 20 for the fuel supply. The ring conduit is supplied with fuel via a fuel supply line 25. With the aid of the injectors 19, when the burner is in operation, the primary injection device 18 introduces fuel into the inflow space 7, in which the injectors 19 are arranged, upstream of the catalyst arrangement 4 and therefore upstream of the swirl generator 6. It may be gathered clearly from FIG. 4, in this case, that the primary injection device 18 has for each swirl generator duct 16 a separate injector 19 which injects or squirts the fuel directly into the respective swirl generator duct 16. In order to achieve a sufficient intermixing of the introduced fuel with the gas flow supplied, an inlet portion 21, which serves as a mixing space, may be formed, upstream of the catalysts 5, in each swirl generator duct 16.

Moreover, according to FIG. 3, a secondary injection device 22 is provided, which serves for the introduction of fuel downstream of the catalyst arrangement 4 into the outflow space 8. This secondary injection device 22 has, here, a central injector 23 which is oriented coaxially to the longitudinal axis 9 and which is expediently designed or oriented in such a way that it squirts or injects the fuel, essentially parallel to the longitudinal axis 9, into the outflow space 8 in the direction of the combustion chamber 2. The secondary injection device 22 may likewise have a plurality of injectors 23. It is clear, furthermore, that the injector or injectors 23 of the secondary injection device 22 may also be arranged eccentrically to the longitudinal axis 9. In particular, a lateral injection of the secondary fuel into the outflow space 8 may also be expedient.

With the aid of the secondary injection device 22, sufficient combustion in the combustion chamber 2 can be implemented for the purpose of starting the burner 1 or for transient operating states. A "pilot mode" of this type is necessary, for example, when the catalysts 5 have not yet reached a sufficiently high operating temperature. The introduction of secondary fuel may be advantageous not only in the transient operating states during the run-up of the burner 1, but also in part-load states, in order to increase the operating reliability of the burner.

Furthermore, it is basically possible to introduce liquid fuel via the secondary injection device 22, without said liquid fuel coming into contact with the catalysts 5. Additional aging of the catalysts 5 due to the supply of liquid fuel can thereby be avoided.

Figure 5:
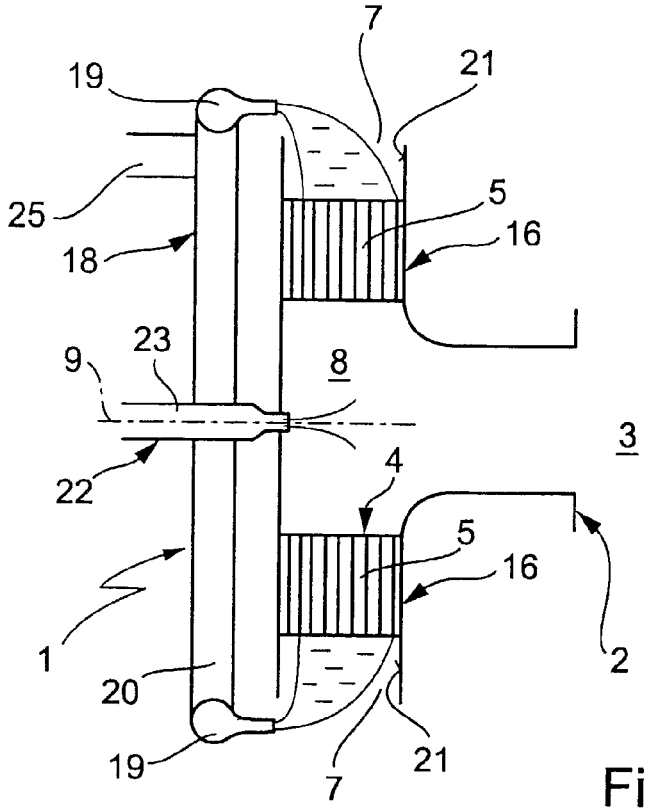
FIGS. 5 and 6 show in each case a longitudinal section, as in FIG. 3, but in other embodiments.
Figure 6:
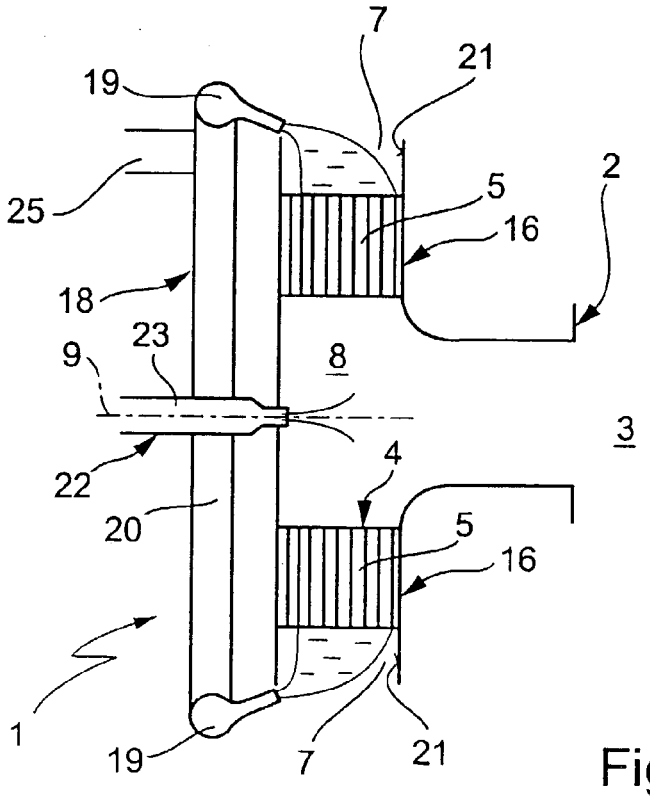
Figure 7:
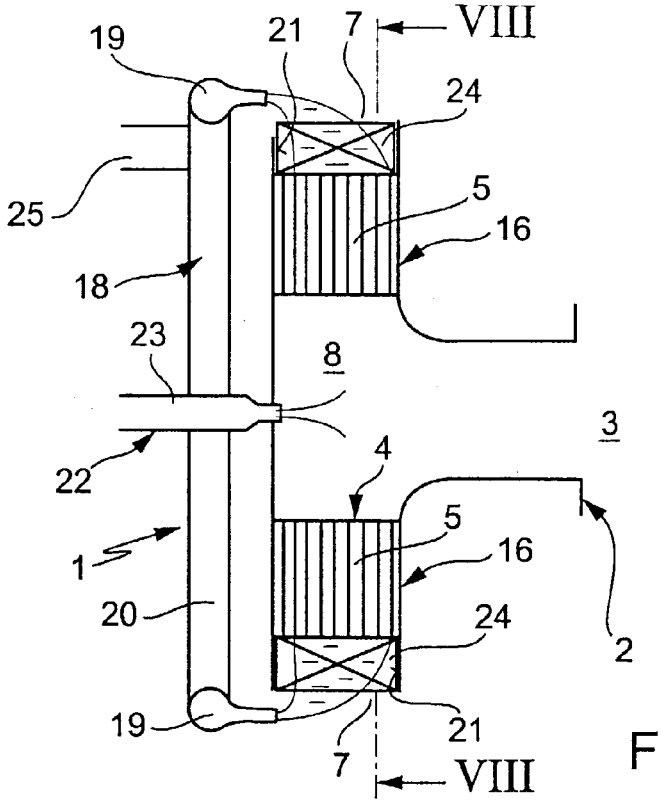
FIG. 7 shows a longitudinal section, as in FIG. 5, but in a development.

Whereas, in the embodiment of FIGS. 3 and 4, the injectors 19 introduce the fuel virtually radially into the inflow space 7 or into the inlet portions 21 of the swirl generator ducts 16, FIGS. 5 to 8 show embodiments in which the injectors 19 squirt or inject the fuel virtually axially into the inflow space 7. FIGS. 5 and 7 show in this case a virtually purely axially injection, while, in FIG. 6, the fuel is injected at an inclination to the longitudinal axis, so that the introduced fuel also acquires a radial component. Injection in this case still takes place outside the swirl generator ducts 16, although the gas flow entering the swirl generator ducts 16 takes up the fuel and deflects it into the inlet portions 21.

Figure 8:
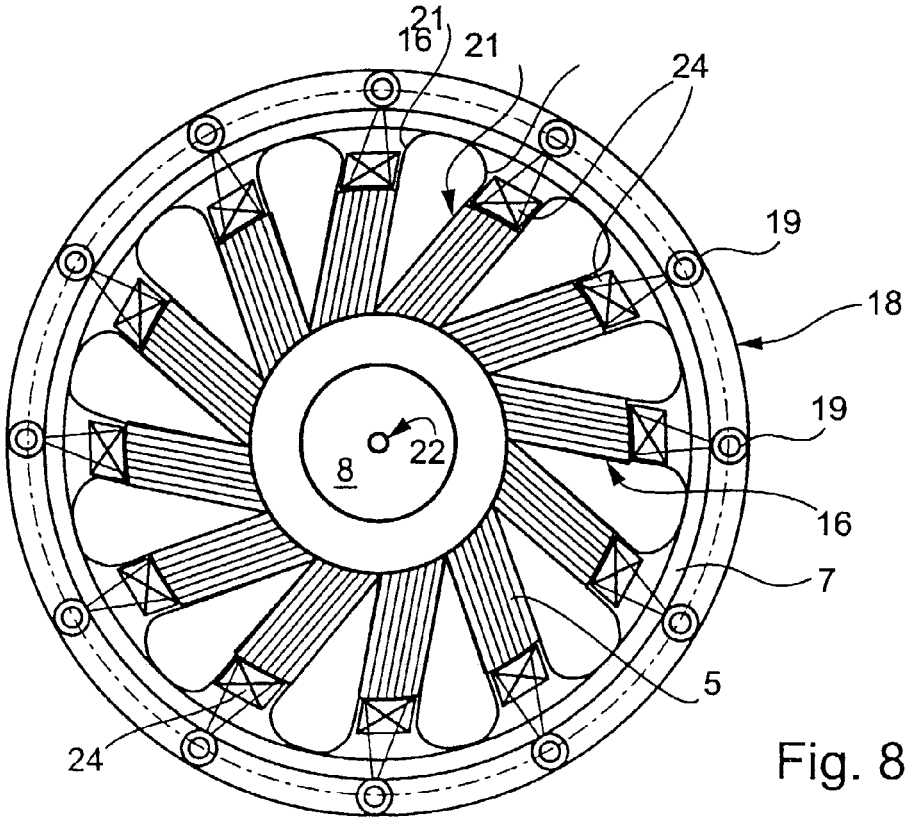
FIG. 8 shows a cross section through the burner according to FIG. 5 along the sectional lines VIII.

In the embodiment of FIGS. 7 and 8, a mixing device 24 is arranged in each case in the flow path between the injectors 19 and the catalysts 5, said mixing device generating an intensive intermixing of the fuel with the gas flow before this fuel/oxidizer mixture enters the respective catalyst 5. For this purpose, the mixing devices 24 are arranged in the inlet portions 21 of the swirl generator ducts 16. In this case, each catalyst 5 or each injector 19 is assigned such a mixing device 24.

Figure 9:
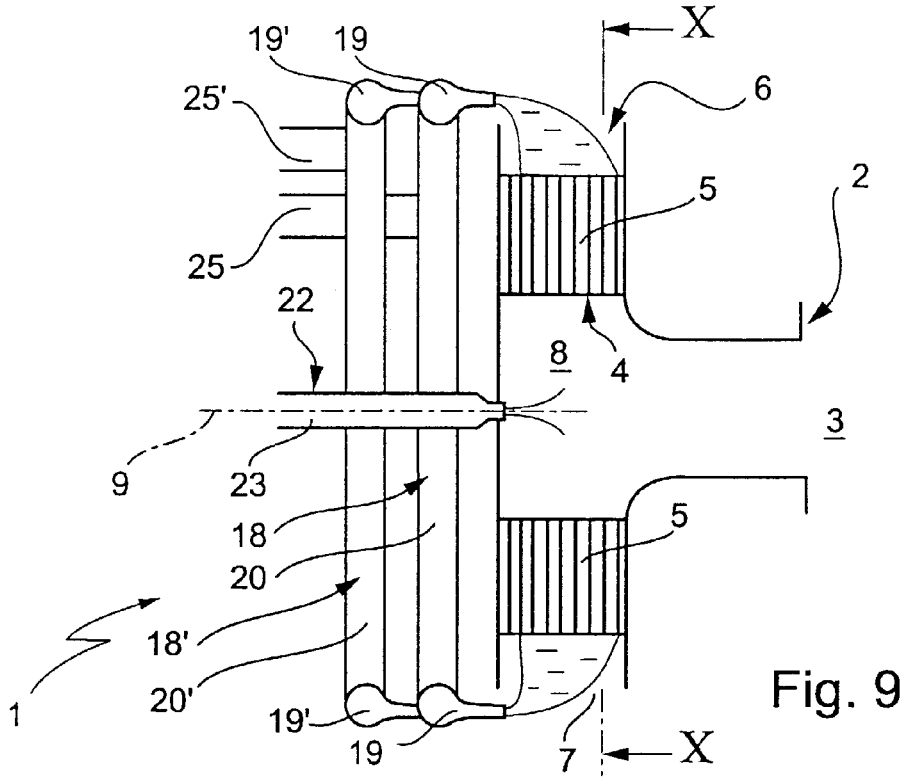
FIG. 9 shows a longitudinal section, as in FIG. 7, but in another embodiment.
Figure 10:
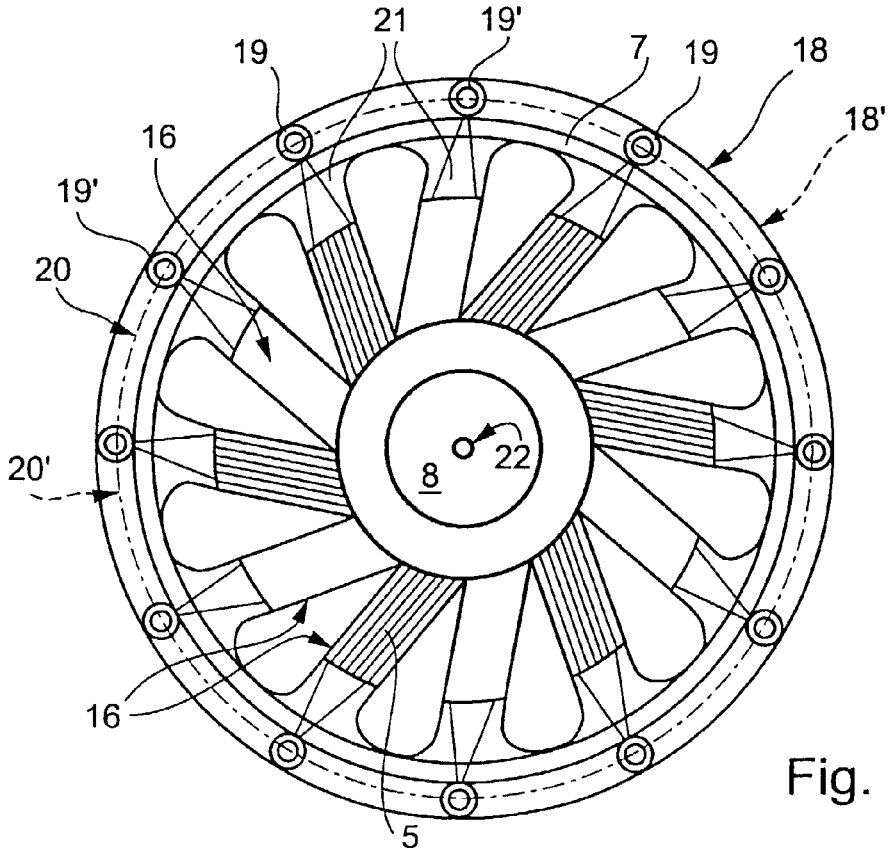
FIG. 10 shows a cross section through the burner according to FIG. 9 along the sectional lines X.

Whereas, in the embodiments shown hitherto, at least one catalyst 5 is arranged in each swirl generator duct 16, FIGS. 9 and 10 show an embodiment in which a catalyst 5 is arranged only in every second swirl generator duct 16 in the circumferential direction. By virtue of this form of construction, an overheating of the catalysts 5 or of the swirl generator 6 can likewise be avoided. In this case, an embodiment is particularly expedient which has two primary injection devices 18 and 18', the first primary injection device 18 supplying fuel to those swirl generator ducts 16 in which one of the catalysts 5 is arranged in each case. In contrast to this, the second primary injection device 18' supplies the other swirl generator ducts 16 in which no catalyst 5 is arranged. The two primary injection devices 18, 18' have in each case a ring conduit 20 and 20', said ring conduits being supplied with fuel independent of one another via fuel supply lines 25 and 25'. Since the two primary injection devices 18, 18' can be activated independently of one another, it is possible to supply a very lean fuel/oxidizer mixture to the catalysts 5 via the first primary injection device 18, with the result that the heating of the catalysts 5 can be controlled relatively efficiently. The remaining fuel, which is necessary for the subsequent reaction in the combustion chamber 2, can then be introduced, bypassing the catalysts 5, into the other swirl generator ducts 16 via the second primary injection device 18'. As a result of the swirl of the flow, an intensive intermixing of the part flows occurs in the outflow space 8, before these together enter the combustion chamber 2.

Although, in the embodiment of FIGS. 9 and 10, every second swirl generator duct 16 is equipped with a catalyst 5, in another embodiment a different distribution of the catalysts 5 to the swirl generator ducts 16 may also be implemented.

Figure 11:
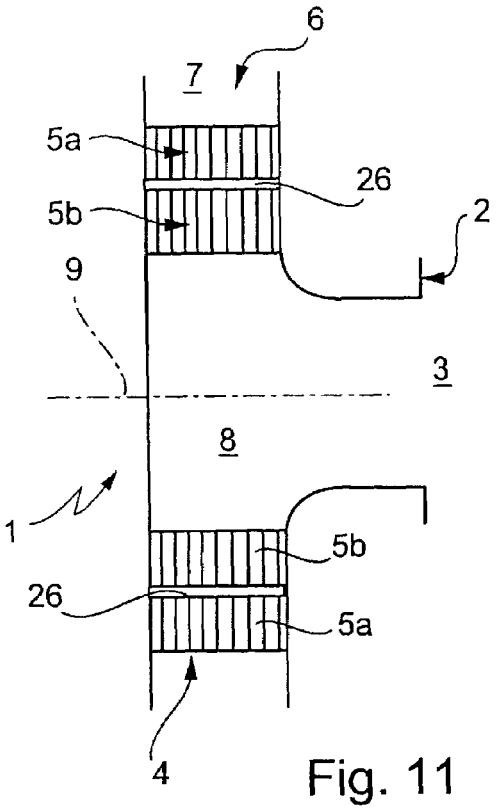
FIGS. 11 to 14 show simplified longitudinal sections through the burner in different embodiments.

Whereas, in the embodiments shown hitherto, the catalyst arrangement 4 has in each case only one catalyst 5 for each swirl generator duct 16, in the embodiment according to FIG. 11 two catalysts 5*a* and 5*b* arranged one behind the other are provided for each swirl generator duct 16. A mixing zone 26 may be provided between the successive catalysts 5*a* and 5*b*. Expediently, the two catalysts 5*a* and 5*b* differ from one another in terms of their catalytic activity. For example, the catalyst 5*a* arranged upstream may have a higher activity, in order to start the combustion reaction, while the catalyst 5*b* following downstream possesses lower activity, in order to avoid an overheating of the catalyst 5*b*.

Figure 12:
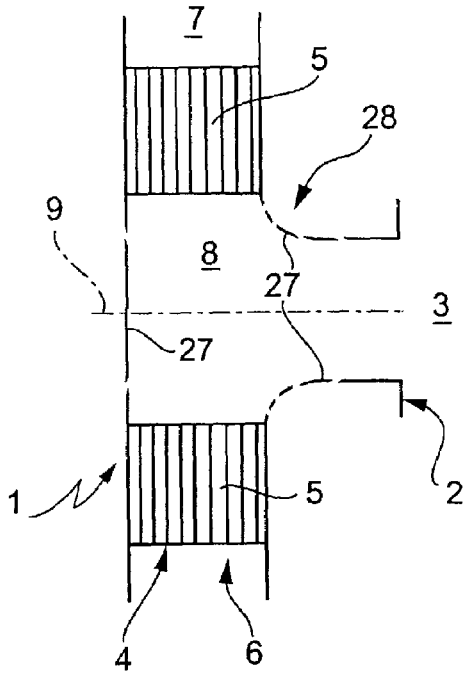
Figure 13:
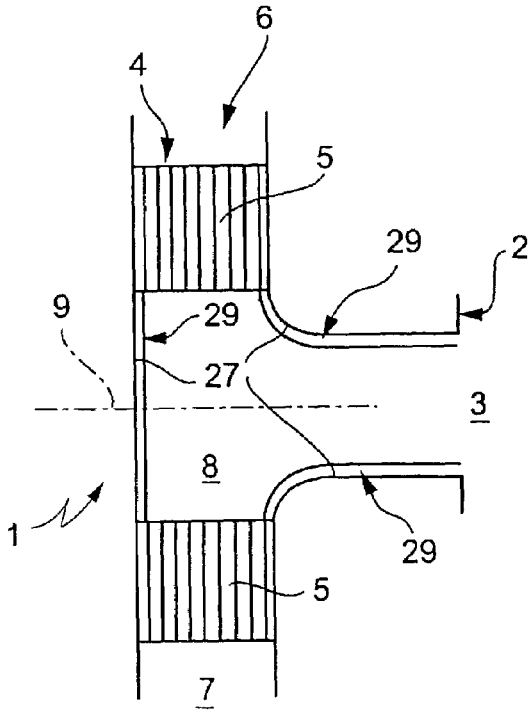
Figure 14:
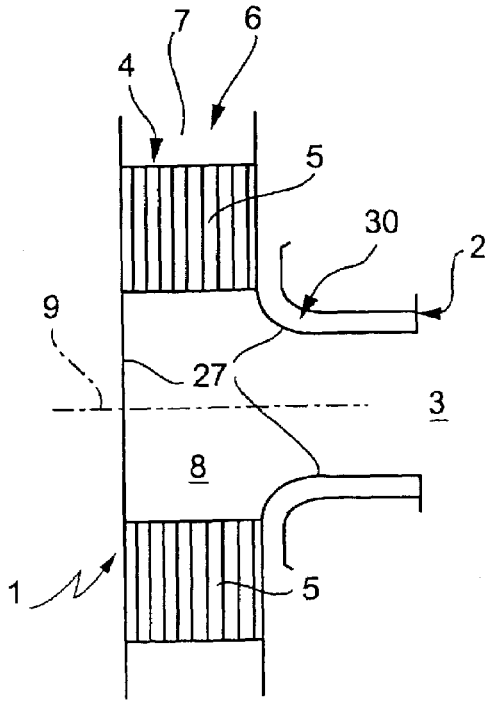

In the embodiments of FIGS. 12 to 14, measures, with the aid of which a wall 27 of the outflow space 8 can be protected against overheating, are shown by way of example. This expediently takes place in the form of active cooling and/or in the form of passive thermal protection. In the embodiment according to FIG. 12, film cooling 28 is implemented along the wall 27 by cooling gas being blown in. In the variant according to FIG. 13, the thermally loaded wall 27 is provided with a heat protection layer 29 which keeps away from the wall 27 the heat occurring in the outflow space 8. In the embodiment according to FIG. 14, the wall 27 is actively cooled, with the aid of cooling 30, between the swirl generator 6 and the combustion chamber 2. For example, cooling takes place by the wall 27 being acted upon by cooling gas.

| List of reference symbols | |
|---|---|
| 1 | Burner |
| 2 | Combustion chamber |
| 3 | Combustion space |
| 4 | Catalyst arrangement |
| 5 | Catalyst |
| 6 | Swirl generator |
| 7 | Inflow space |
| 8 | Outflow space |
| 9 | Longitudinal axis of 1 |
| 10 | Transition between 8 and 2 |
| 11 | Cross-sectional widening |
| 12 | First vortex system |
| 13 | Second vortex system |
| 14 | Recirculation zone |
| 15 | Flame front |
| 16 | Swirl generator duct |
| 17 | Outlet cross section of 8 |
| 18 | Primary injection device |
| 19 | Injector |
| 20 | Ring conduit |
| 21 | Inlet portion of 16 |
| 22 | Secondary injection device |
| 23 | Injector |
| 24 | Mixing device |
| 25 | Fuel supply line |
| 26 | Mixing zone |
| 27 | Wall of 8 |
| 28 | Film cooling |
| 29 | Heat protection layer |
| 30 | Cooling |

The invention claimed is:

1. A catalytic burner at or for a combustion chamber comprising:

at least one catalyst through which flow passes when the burner is in operation;

a radially outer inflow space;

a radially inner outflow space leading axially to the combustion chamber; and a swirl generator through which flow passes when the burner is in operation;

wherein the swirl generator comprises a radial swirl generator which is arranged between the radially outer inflow space and the radially inner outflow space;

wherein the swirl generator comprises the at least one catalyst.

2. The burner as claimed in claim 1, further comprising at least one primary injection device upstream of the at least one catalyst for the introduction of fuel into the inflow space.

3. A burner as claimed in claim 2, wherein the radial swirl generator comprises a plurality of rectilinear swirl generator ducts which are each inclined in a circumferential direction with respect to the radial direction and which connect the inflow space to the outflow space, and wherein the primary injection device comprises, for each swirl generator duct, at least one injector for the introduction of fuel into the associated swirl generator duct.

4. The burner as claimed in claim 2, wherein the primary injection device comprises a plurality of injectors for the introduction of fuel, and further comprising at least one mixing device arranged between the plurality of injectors and the at least one catalyst.

5. The burner as claimed in claim 4, wherein the radial swirl generator comprises a plurality of rectilinear swirl generator ducts which are each inclined in a circumferential direction with respect to the radial direction and which connect the inflow space to the outflow space, wherein at least one catalyst is arranged in some of the swirl generator ducts, and wherein one of said at least one mixing device is arranged in each swirl generator duct in which at least one catalyst is arranged.

6. The burner as claimed in claim 2, further comprising two primary injection devices independent of one another;

wherein the radial swirl generator comprises a plurality of rectilinear swirl generator ducts which are each inclined in a circumferential direction with respect to the radial direction and which connect the inflow space to the outflow space;

wherein at least one catalyst is arranged only in some of the swirl generator ducts, while no catalysts are arranged in the other swirl generator ducts;

wherein one primary injection device serves for the introduction of fuel into the swirl generator ducts equipped with the catalysts, while the other primary injection device serves for the introduction of fuel into the other swirl generator ducts.

7. The burner as claimed in claim 1, further comprising:

an injection device downstream of the at least one catalyst for the introduction of fuel into the outflow space, into the combustion chamber, or both.

8. The burner as claimed in claim 7, wherein the injection device is configured and arranged so that it introduces fuel into the outflow space centrally in the direction of the combustion chamber.

9. The burner as claimed in claim 1, further comprising:

a wall of the outflow space which is cooled, thermally protected, or both.

10. The burner as claimed in claim 1, wherein the burner is configured and arranged so that, when the burner is in operation, at least in the outflow space, a flow velocity is higher than a turbulent flame velocity, so that, when the burner is in operation, a dwell time of the flow in the outflow space is shorter than a time delay up to the autoignition of a partially reacted hot fuel/oxidizer mixture flowing into the outflow space, or both.

11. The burner as claimed in claim 1, wherein the radial swirl generator is positioned downstream of the radially outer inflow space.

12. The burner as claimed in claim 1, wherein the radial swirl generator is positioned upstream of the radially inner outflow space.

13. The burner as claimed in claim 1, wherein the radially inner outflow space is located downstream of the radially outer inflow space.

14. A catalytic burner at or for a combustion chamber comprising:

at least one catalyst through which flow passes when the burner is in operation;

a radially outer inflow space;

a radially inner outflow space leading axially to the combustion chamber; and a swirl generator through which flow passes when the burner is in operation, wherein the swirl generator comprises a radial swirl generator which is arranged between the radially outer inflow space and the radially inner outflow space;

wherein the radial swirl generator comprises a plurality of rectilinear swirl generator ducts which are each inclined in a circumferential direction with respect to the radial direction and which connect the inflow space to the outflow space.

15. The burner as claimed in claim 14, wherein at least one catalyst is arranged in some of the swirl generator ducts.

16. The burner as claimed in claim 15, wherein the catalysts arranged in the swirl generator ducts each comprise a multiplicity of catalyst ducts running parallel to one another and to the associated swirl generator duct.

17. The burner as claimed in claim 16, wherein, at least in some of the catalysts, some of the catalyst ducts are catalytically active, while other catalyst ducts are catalytically inactive.

18. The burner as claimed in claim 14, wherein the at least one catalyst comprises at least two catalysts which differ from one another in catalytic activity and are each arranged at least in some of the swirl generator ducts.

19. The burner as claimed in claim 14, further comprising at least one primary injection device upstream of the at least one catalyst for the introduction of fuel into the inflow space.

20. A burner as claimed in claim 19, wherein the radial swirl generator comprises a plurality of rectilinear swirl generator ducts which are each inclined in a circumferential direction with respect to the radial direction and which connect the inflow space to the outflow space, and wherein the primary injection device comprises, for each swirl generator duct, at least one injector for the introduction of fuel into the associated swirl generator duct.

21. The burner as claimed in claim 19, wherein the primary injection device comprises a plurality of injectors for the introduction of fuel, and further comprising at least one mixing device arranged between the plurality of injectors and the at least one catalyst.

22. The burner as claimed in claim 21, wherein the radial swirl generator comprises a plurality of rectilinear swirl generator ducts which are each inclined in a circumferential direction with respect to the radial direction and which connect the inflow space to the outflow space, wherein at least one catalyst is arranged in some of the swirl generator ducts, and wherein one of said at least one mixing device is arranged in each swirl generator duct in which at least one catalyst is arranged.

23. The burner as claimed in claim 19, further comprising two primary injection devices independent of one another;

wherein the radial swirl generator comprises a plurality of rectilinear swirl generator ducts which are each inclined in a circumferential direction with respect to the radial direction and which connect the inflow space to the outflow space;

wherein at least one catalyst is arranged only in some of the swirl generator ducts, while no catalysts are arranged in the other swirl generator ducts;

wherein one primary injection device serves for the introduction of fuel into the swirl generator ducts equipped with the catalysts, while the other primary injection device serves for the introduction of fuel into the other swirl generator ducts.

24. The burner as claimed in claim 14, further comprising:

an injection device downstream of the at least one catalyst for the introduction of fuel into the outflow space, into the combustion chamber, or both.

25. The burner as claimed in claim 24, wherein the injection device is configured and arranged so that it introduces fuel into the outflow space centrally in the direction of the combustion chamber.

26. The burner as claimed in claim 14, further comprising:

a wall of the outflow space which is cooled, thermally protected, or both.

27. The burner as claimed in claim 14, wherein the burner is configured and arranged so that, when the burner is in operation, at least in the outflow space, a flow velocity is higher than a turbulent flame velocity, so that, when the burner is in operation, a dwell time of the flow in the outflow space is shorter than a time delay up to the autoignition of a partially reacted hot fuel/oxidizer mixture flowing into the outflow space, or both.

28. The burner as claimed in claim 14, wherein the radial swirl generator is positioned downstream of the radially outer inflow space.

29. The burner as claimed in claim 14, wherein the radial swirl generator is positioned upstream of the radially inner outflow space.

30. The burner as claimed in claim 14, wherein the radially inner outflow space is located downstream of the radially outer inflow space.

31. A catalytic burner at or for a combustion chamber comprising:

at least one catalyst through which flow passes when the burner is in operation;

a radially outer inflow space;

a radially inner outflow space leading axially to the combustion chamber; and a swirl generator through which flow passes when the burner is in operation, wherein the swirl generator comprises a radial swirl generator which is arranged between the radially outer inflow space and the radially inner outflow space;

wherein the at least one catalyst is positioned between the radially outer inflow space and the radially inner outflow space.

32. The burner as claimed in claim 31, further comprising at least one primary injection device upstream of the at least one catalyst for the introduction of fuel into the inflow space.

33. A burner as claimed in claim 32, wherein the radial swirl generator comprises a plurality of rectilinear swirl generator ducts which are each inclined in a circumferential direction with respect to the radial direction and which connect the inflow space to the outflow space, and wherein the primary injection device comprises, for each swirl generator duct, at least one injector for the introduction of fuel into the associated swirl generator duct.

34. The burner as claimed in claim 32, wherein the primary injection device comprises a plurality of injectors for the introduction of fuel, and further comprising at least one mixing device arranged between the plurality of injectors and the at least one catalyst.

35. The burner as claimed in claim 34, wherein the radial swirl generator comprises a plurality of rectilinear swirl generator ducts which are each inclined in a circumferential direction with respect to the radial direction and which connect the inflow space to the outflow space, wherein at least one catalyst is arranged in some of the swirl generator ducts, and wherein one of said at least one mixing device is arranged in each swirl generator duct in which at least one catalyst is arranged.

36. The burner as claimed in claim 32, further comprising two primary injection devices independent of one another;

wherein the radial swirl generator comprises a plurality of rectilinear swirl generator ducts which are each inclined in a circumferential direction with respect to the radial direction and which connect the inflow space to the outflow space;

wherein at least one catalyst is arranged only in some of the swirl generator ducts, while no catalysts are arranged in the other swirl generator ducts;

wherein one primary injection device serves for the introduction of fuel into the swirl generator ducts equipped with the catalysts, while the other primary injection device serves for the introduction of fuel into the other swirl generator ducts.

37. The burner as claimed in claim 31, further comprising:

an injection device downstream of the at least one catalyst for the introduction of fuel into the outflow space, into the combustion chamber, or both.

38. The burner as claimed in claim 37, wherein the injection device is configured and arranged so that it introduces fuel into the outflow space centrally in the direction of the combustion chamber.

39. The burner as claimed in claim 31, further comprising:

a wall of the outflow space which is cooled, thermally protected, or both.

40. The burner as claimed in claim 31, wherein the burner is configured and arranged so that, when the burner is in operation, at least in the outflow space, a flow velocity is higher than a turbulent flame velocity, so that, when the burner is in operation, a dwell time of the flow in the outflow space is shorter than a time delay up to the autoignition of a partially reacted hot fuel/oxidizer mixture flowing into the outflow space, or both.

41. The burner as claimed in claim 31, wherein the radial swirl generator is positioned downstream of the radially outer inflow space.

42. The burner as claimed in claim 31, wherein the radial swirl generator is positioned upstream of the radially inner outflow space.

43. The burner as claimed in claim 31, wherein the radially inner outflow space is located downstream of the radially outer inflow space.

* * * * *